US011570557B2

(12) United States Patent
Gomez

(10) Patent No.: US 11,570,557 B2
(45) Date of Patent: Jan. 31, 2023

(54) METHOD FOR DIRECTION-DEPENDENT NOISE REJECTION FOR A HEARING SYSTEM CONTAINING A HEARING APPARATUS AND HEARING SYSTEM

(71) Applicant: SIVANTOS PTE. LTD., Singapore (SG)

(72) Inventor: Gabriel Gomez, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 38 days.

(21) Appl. No.: 17/352,530

(22) Filed: Jun. 21, 2021

(65) Prior Publication Data

US 2021/0400402 A1 Dec. 23, 2021

(30) Foreign Application Priority Data

Jun. 18, 2020 (DE) ..... 10 2020 207 579.4

(51) Int. Cl.
*H04R 25/00* (2006.01)
*G10L 25/51* (2013.01)

(52) U.S. Cl.
CPC ..... *H04R 25/505* (2013.01); *G10L 25/51* (2013.01); *H04R 25/353* (2013.01); (Continued)

(58) Field of Classification Search
CPC .. H04R 25/505; H04R 25/353; H04R 25/405; H04R 25/407; H04R 25/604; (Continued)

(56) References Cited

U.S. PATENT DOCUMENTS 10,547,956 B2 1/2020 Kamkar-Parsi et al.
2013/0010973 A1 1/2013 Ma
(Continued)

FOREIGN PATENT DOCUMENTS

DE 102016225204 A1 6/2018
EP 2658289 A1 10/2013
WO 2011101045 A1 8/2011

OTHER PUBLICATIONS

Laknaur A et al: "Design of a window comparator with adaptive error threshold for online testing applications", Microelectronics Journal, Mackintosh Publications LTD. Luton, GB, vol. 40, No. 9, Sep. 1, 2009 (Sep. 1, 2009), pp. 1257-1263, XP026547120, ISSN: 0026-2692, DOI:10.1016/J.MEJ0.2008.01.093.

*Primary Examiner* — Tuan D Nguyen
(74) *Attorney, Agent, or Firm* — Laurence A. Greenberg; Werner H. Stemer; Ralph E. Locher

(57) ABSTRACT

In a method for direction-dependent noise rejection for a hearing system, first and second input transducers are used to generate an interference signal and a target signal from a sound from the surroundings. The interference signal and/or the target signal are referenced to a useful signal source arranged in a target direction. The target signal is generated with a target directivity pattern. For each of a first plurality of frequency bands, an acoustic characteristic of the target signal is compared with a corresponding acoustic characteristic of the interference signal, and the comparison is used to ascertain a provisional weighting factor. The provisional weighting factor is used to form for the frequency band a weighting factor for the respective frequency bands. An input signal to be processed is weighted on a frequency-band-by-frequency-band basis using the respective weighting factor, and the weighted input signal is used to generate an output signal.

19 Claims, 4 Drawing Sheets

(52) U.S. Cl.
CPC ..... *H04R 25/405* (2013.01); *H04R 25/407* (2013.01); *H04R 25/604* (2013.01); *H04R 25/65* (2013.01); *H04R 2225/43* (2013.01)

(58) Field of Classification Search
CPC .... H04R 25/65; H04R 2225/43; H04R 3/005; H04R 1/1083; H04R 2410/01; H04R 25/48; G10L 25/51
See application file for complete search history.

(56) References Cited

U.S. PATENT DOCUMENTS

| | | | | |
|---|---|---|---|---|
| 2018/0098160 | A1* | 4/2018 | Jensen ..... | H04R 25/552 |
| 2018/0176694 | A1 | 6/2018 | Kamkar-Parsi et al. | |
| 2018/0176698 | A1* | 6/2018 | Kamkar-Parsi ..... | H04R 25/405 |
| 2019/0394586 | A1* | 12/2019 | Pedersen ..... | H04R 25/507 |

* cited by examiner

METHOD FOR DIRECTION-DEPENDENT NOISE REJECTION FOR A HEARING SYSTEM CONTAINING A HEARING APPARATUS AND HEARING SYSTEM

CROSS-REFERENCE TO RELATED APPLICATION

This application claims the priority, under 35 U.S.C. § 119, of German patent application DE 10 2020 207 579.4, filed Jun. 18, 2020; the prior application is herewith incorporated by reference in its entirety.

BACKGROUND OF THE INVENTION

Field of the Invention

The invention relates to a method for direction-dependent noise rejection for a hearing system containing a hearing apparatus, wherein at least one first input transducer of the hearing system and a second input transducer of the hearing system are used to generate an interference signal and a target signal from a sound from the surroundings. The interference signal and/or the target signal being referenced to a first useful signal source arranged in a first direction, wherein, for each of at least one plurality of frequency bands, an acoustic characteristic of the target signal and a corresponding acoustic characteristic of the interference signal are used to ascertain a weighting factor for the respective frequency band. Wherein an input signal to be processed for the hearing system is weighted on a frequency-band-by-frequency-band basis using the respective weighting factor, and the thus weighted input signal is used to generate an output signal.

Hearing devices are portable devices that are used to compensate for a hearing loss of a respective wearer. This first of all involves a level increase for individual frequencies, which is usually individually dependent on the respective wearer, being performed in order to render sound audible even in those frequency bands for which the sound would otherwise be inaudible or would be perceived too quietly without a hearing device as a result of the hearing loss. To provide the wearer with additional support, hearing devices often also amplify a target signal (usually voice) in comparison with disturbing noise from the surroundings. The applicable increase in the signal-to-noise ratio (SNR) is chiefly performed using two separate approaches.

The first approach uses two or more microphones that can be used to achieve a direction-dependent gain for a target signal, while sound from other directions can be attenuated, by means of directional microphones. Whereas this often allows satisfactory noise rejection to be achieved, the spatial perception of the surroundings of the wearer is often impaired as a result of the rejection of sound from individual spatial directions.

The second type of noise reduction in hearing devices causes the energy of interference signals to be filtered out of the overall signal. This is often performed by means of spectral subtraction, e.g using a Wiener filter. The spectrum of interference signals is estimated (e.g. from pauses in speech) in order to subsequently subtract this spectrum from the overall signal. Whereas spectral subtraction delivers very good results for stationary or only slowly variable noise, it works only unsatisfactorily for fast spectral changes in the interference signal or in so-called "cocktail party" situations. Moreover, spectral subtraction can frequently produce artefacts that can impair the voice signal.

The problems described also relate in a broader sense to other hearing apparatuses in which an input signal needs to be processed and supplied to the ear of a wearer, e.g. headphone headsets for communication or the like.

BRIEF SUMMARY OF THE INVENTION

The invention is therefore based on the object of specifying a method for direction-dependent noise rejection for a hearing system having a hearing apparatus, which is supposed to permit the most efficient and nevertheless naturally sounding noise rejection possible.

The cited object is achieved according to the invention by a method for direction-dependent noise rejection for a hearing system containing a hearing apparatus, in particular a hearing device, wherein at least one first input transducer of the hearing system and a second input transducer of the hearing system are used to generate an interference signal and a target signal from a sound from the surroundings. The interference signal and/or the target signal being referenced to a useful signal source arranged in a target direction, wherein the target signal is generated with a target directivity pattern that has a homogeneous or substantially homogeneous characteristic over a half-space opposite the target direction. Wherein, for each of at least one first plurality of frequency bands, an acoustic characteristic of the target signal is compared with a corresponding acoustic characteristic of the interference signal, a signal level and/or a signal amplitude and/or a signal power of the respective signal preferably being used for the acoustic characteristic in each particular case, and the comparison is used to ascertain a provisional weighting factor, the range of values of which comprises at least three values. The provisional weighting factor being used to form for the frequency band a weighting factor for the respective frequency band in each particular case, and wherein an input signal to be processed for the hearing system is weighted on a frequency-band-by-frequency-band basis using the respective weighting factor, and the thus weighted input signal to be processed is used to generate an output signal. Advantageous and individually inventive configurations are the subject of the subclaims and of the description below.

A hearing apparatus in particular includes a hearing device that is preferably configured and set up to compensate for a hearing loss and/or a hearing deficiency of its wearer. Similarly, it also includes any apparatus by means of which a sound signal is converted into a corresponding input signal by an input transducer and is conditioned by way of appropriate signal processing for reproduction to the ear of the wearer of the apparatus, that is to say for example headphones or a headset for communication. An input transducer in this context below generally covers any form of electroacoustic transducer that is set up to convert an ambient sound into a corresponding electrical signal, the voltage or current amplitudes of which preferably reflect the amplitude characteristic of the ambient sound. A hearing system in this context is in particular intended to be understood to mean any system that comprises the hearing apparatus and possibly one or more further apparatuses and has the requisite number of input transducers and also a control or computer device for processing the applicable signals. Wherein if the hearing system is not embodied solely by the hearing apparatus, a data connection, in particular a wireless connection, can be made between the further apparatus(es) and the hearing apparatus for the purpose of transmitting the signals used and/or possibly further information. In particular, the hearing system may also be embodied completely by the hearing apparatus, however.

The generation of an interference signal and a target signal using at least one first input transducer of the hearing system and a second input transducer of the hearing system in particular contains the interference signal and/or the target signal each being formed as a directional signal generated using the two signals from the first and second input transducers in each particular case. Similarly, however, this also includes the interference signal being generated merely using the first input transducer, and the target signal being generated merely using the second input transducer, a converse association with the respective input transducers also being possible in this case. The interference signal and/or the target signal are referenced to a useful signal source in this instance, which in particular means that the target signal contains a higher proportion of signals from the useful signal source than the interference signal. This can in particular be achieved by attenuating the interference signal in the target direction, but also by relatively emphasizing the target direction compared to other directions or angle ranges in the target signal, or else by means of both cited measures.

Generation of the target signal with a target directivity pattern that has a homogeneous or substantially homogeneous characteristic over a half-space opposite the target direction preferably includes the target directivity pattern being obtained in this instance as the result of signal processing of the signal(s) used from the input transducer(s) used, and in particular being referenced to an open field as the result of said signal processing. The described characteristic of the target directivity pattern over said half-space in this instance in particular comprises the characteristic of the sensitivity according to the target directivity pattern having no inflection points and no local minima, and/or the sensitivity in said half-space merely having variations that are suppressed by at least 10 dB, preferably 15 dB, in comparison with the maximum sensitivity of the target signal (preferably in the target direction), i.e. the difference between the maximum and minimum sensitivities in said half-space is no more than −10 dB, preferably no more than −15 dB, referenced to the maximum sensitivity of the target signal (in the target direction). Such variations can then be ignored in comparison with a signal contribution from the target direction.

A homogeneous characteristic in this context means in particular that the sensitivity in said half-space does not vary within the framework of technical possibility and accuracy. If the angle 0° is assigned to the target direction, the half-space opposite the latter is embodied by the angle range from 90° to 270°. In particular, the characteristic of the target directivity pattern is homogeneous or substantially homogeneous for as large an angle range as possible, with the exception of a range of e.g. +/−45° around the target direction, the transition to said range around the target direction preferably being continuous.

A homogeneous characteristic of the target directivity pattern can in particular be achieved by means of an omnidirectional target signal. In this case, the signal processing for generating the target signal from the signals from the first and second input transducers involves appropriate directional microphones; to generate just from a signal from one of the two input transducers, this can in particular mean that the signal processing does not impress a directional effect on the target signal.

Weighting factors for noise rejection are now ascertained on a frequency-band-by-frequency-band basis for an input signal to be processed that is generated either using said first input transducer and/or said second input transducer, or else using a further input transducer of the hearing system, which weighting factors can be used to cut frequency bands with a high proportion of noise in the input signal to be processed or to relatively boost frequency bands with a high proportion of a useful signal from the useful signal source. The input signal to be processed is preferably embodied in this instance by the signal from a single input transducer, that is to say from the first or the second or possibly said further input transducer, wherein preprocessing such as e.g. A/D conversion, but possibly also pre-amplification, is preferably supposed to be treated as part of the input transducer.

To ascertain the weighting factors in individual frequency bands, an acoustic characteristic of the target signal is now formed for each of a plurality of frequency bands, and compared with the corresponding acoustic characteristic of the interference signal.

The acoustic characteristic is preferably such that information about the energy content in the relevant frequency band can be provided for the respective signal. Particularly preferably, the acoustic characteristic used in each particular case is a signal level and/or a signal amplitude and/or a signal power of the respective signal, said characteristic being able to be formed firstly directly by one of said signal magnitudes, or from a monotonous, in particular strictly monotonous, function, e.g a quadratic or else logarithmic function of the signal level and/or the signal power and/or the signal amplitude. Therefore, e.g. a quotient of the signal level of the target signal in the frequency band as numerator and the signal level of the interference signal in the frequency band as denominator is formed for a frequency band, or the signal levels are compared with one another in another way.

The comparison of said acoustic characteristics is then mapped to the provisional weighting factor, the range of values of which comprises at least three values, the range of values being able to be discrete or continuous in this case.

The comparison can in particular be made by means of division of the characteristics. Preferably, a quotient is formed for each of at least some frequency bands of the first plurality using the acoustic characteristic of the target signal as numerator and using the corresponding acoustic characteristic of the interference signal as denominator, and the respective quotient is used to form the provisional weighting factor. The provisional weighting factor may be continuous or discrete in this case. In particular, in the second case, the quotient for each of the relevant frequency bands is mapped monotonously to a range of values comprising at least three discrete values to form the provisional weighting factor, e.g. by assigning individual intervals of the range of values of the quotient to individual discrete values of the provisional weighting factor.

However, the comparison can also be made such that for at least some frequency bands of the first plurality the acoustic characteristic of the target signal and the corresponding acoustic characteristic of the interference signal are subjected to a plurality of magnitude comparisons, wherein one of the two characteristics is scaled differently for each of the individual magnitude comparisons, and wherein the magnitude comparisons are used to assign the respective value from the discrete, at least three-valued range of values to the provisional weighting factor.

By way of example, for each of individual frequency bands, the signal level of the useful signal is compared with the signal level of the interference signal in the band. If the signal level of the useful signal is greater, the greatest value from the discrete range of values is assigned to the frequency band for the provisional weighting factor (e.g. 1.3). If the signal level of the interference signal is greater, however, then e.g. the target signal can be multiplied by a predefined factor >1, and the next comparison with the interference signal level can take place. If the useful signal level is now greater, then the next value from the discrete range of values (e.g. 0.75) can be assigned to the provisional weighting factor for the frequency band. If the interference signal level is still greater, then either the smallest value (e.g. 0.5) can be assigned for the provisional weighting factor, or the process of scaling the useful signal can first be repeated once again.

The weight factor, ascertained as described, for the respective frequency band can now be used to weight the input signal to be processed as appropriate. This can be effected firstly by means of direct application of the weight factor to the signal components of the input signal to be processed in the relevant frequency band, or by means of temporal averaging and/or normalization of the weight factor before multiplication onto the signal components of the associated frequency band. Additionally, individual static correction factors can also be applied on a frequency-band-by-frequency-band basis that e.g. take into consideration spectral differences in the input transducers involved for different frequency bands, but possibly also level and/or delay differences, and correct the relevant influence on the noise rejection.

The thus weighted input signal to be processed is now used to generate an output signal. This can be effected firstly by virtue of the output signal being generated directly from the signal components of said weighted input signal. If necessary, however, further signal processing of these signal components can also be effected in this case, such as e.g. rejection of acoustic feedback or the like, additional frequency-band-dependent cut or boost on the basis of the individual audiological requirements of the wearer of the hearing apparatus. The output signal can also additionally be produced using signal components of a further signal, however, for example by directional microphones by means of a further signal, but also by way of the in particular wideband mixing of the weighted input signal with an omnidirectional signal or a directional signal.

The invention is based on the assumption that a useful signal from the useful signal source and a noise signal from one or more noise sources have different spectral information at each individual time, i.e. the amplitude spectrum and the phase of the sound from the different sources are different at any time. Since the sound pressure fields of multiple sources add up through superposition, the spectral information is also a sum of the individual components of the individual sources. This means in particular that the sound pressure at the location of an input transducer at each time is a sum of individual sources and reflections, which are possibly also filtered by transfer functions that take into consideration the propagation of the sound from a source to the respective input transducer. It follows that subtraction of the individual spectral components, if known, can lead to selective attenuation or removal of these components from the total sum of the target signal (e.g. at the location of an input transducer for the input signal to be processed), or wanted signal components can be specifically selected and boosted.

For the purpose of implementation, the frequency-band-by-frequency-band energy proportions of the useful signal and the noise signal are now preferably used at each time or at a sufficiently dense succession of discrete times, the latter for example embodied by way of the sampling rate or else by way of the individual "frames" of a spectral analysis by means of FFT or the like. In order to ascertain what energy proportions come from the useful signal source or the noise sources at each time, direction-dependent filtering of the sound field by means of the target signal and the interference signal is performed such that the proportion of the useful signal from the useful signal source is decisively higher in the generated target signal than in the generated interference signal, which accordingly contains a much higher proportion of noise in its total energy.

The assumption is thus now used that there is a higher spectral proportion of useful signal in those frequency bands in which the acoustic characteristic, which provides information about the respective energy content in the frequency band, is greater for the target signal than for the interference signal. According to the comparison formed as described, the input signal to be processed can accordingly be relatively boosted in such a frequency band in comparison with other frequency bands in which the acoustic characteristic of the interference signal is greater than the acoustic characteristic of the target signal, since a higher proportion of noise and a smaller useful signal component are assumed in those frequency bands.

In this instance, firstly the spatial isolation that the target signal carries out toward the interference signal with respect to the sound from the useful signal source is preferably exploited. Secondly, a particularly natural sound can be achieved as a result of the substantially homogeneous characteristic of the target signal in the half-space opposite the target direction.

In order to be able to take into consideration the spectral proportions of noise from noise sources away from the target direction as comprehensively as possible, an interference signal that likewise has as homogeneous a sensitivity toward the noise sources to be cut as possible in said half-space as described above is preferably used. When comparing the two characteristics of the useful signal and the interference signal, it is therefore possible to achieve the effect that the result of the comparison, and hence the associated weighting factor for the relevant frequency band, is only negligibly dependent on a direction of a noise source in said half-space. Only the volume of the noise from this half-space thus decisively influences the outcome of the comparison in the frequency band.

Spectral proportions of noise from a distinctly different direction than the target direction can therefore be cut from the input signal to be processed such that a natural sound is retained. The advantages are not restricted to said half-space, but rather also have a limited effect beyond the exact boundaries of the half-space under continuity and regularity conditions for the signals used.

Preferably, the weighting factor is formed for each of a second plurality of frequency bands using the provisional weighting factor and using a normalization factor that is determined on the basis of at least one provisional weighting factor of the second plurality of frequency bands. Preferably, the normalization factor is determined directly, that is to say in particular linearly and preferably identically, from a provisional weighting factor of one of the frequency bands, possibly after temporal averaging. Such normalization permits weighting of the individual frequency bands to be related to one another by the normalization, for example by virtue of all relevant frequency bands being subject to the same normalization. During normalization, for example averagings can be used to take into consideration individual level peaks, as a result of which the weighting factors are not subject to sudden changes owing to variations in the normalization without there possibly actually being a significant instantaneous change in the sound levels for the target signal or the interference signal in a frequency band. Determination of the weighting factor on the basis of at least one provisional weighting factor in particular comprises a respective temporal averaging of the acoustic characteristics of the respective target signal and interference signal on which the at least one provisional weighting factor is based. In particular, the normalization factor can also have its value capped.

Advantageously, the normalization factor for a frequency band is determined using a temporal average of the values of the acoustic characteristics used and/or of the values of the provisional weighting factor in the same frequency band, and/or using a maximum and/or a sum of the values of the provisional weighting factors and/or of a signal level over all relevant frequency bands. This in particular also includes a temporal average over the instantaneous maximum of the frequency-band-by-frequency-band values of the individual provisional weighting factors and a maximum over the temporal averages of all relevant frequency bands.

Normalization of the provisional weighting factor in a frequency band using the maximum of the values of the provisional weighting factors over all relevant frequency bands has the advantage, particularly for a comparison using a quotient, that for that frequency band in which the provisional weight factor is at a maximum, that is to say the most spectral energy is contained in the target signal in comparison with the interference signal (and therefore the proportion of the useful signal is probably greatest), the weighting factor assumes the maximum value of 1. A corresponding weighting of the input signal to be processed is consistent with a signal that is unchanged by the weighting. Other frequency bands for which the provisional weighting factor is not at a maximum are cut on account of the normalization, the cut ending up being all the greater the smaller the useful signal component in the interference signal compared with the target signal in the frequency band, and therefore the smaller the provisional weighting factor of the frequency band.

This approach makes it possible to avoid hard limiting of the weighting factor to a fixed value, as a result of which differences in the spectrum and in the level are also still retained for noise and interference signal components on a direction-dependent basis, further promoting a natural sound.

Of particular advantage in this instance is normalization using a temporal average over the instantaneous maximum of the frequency-band-by-frequency-band values of the individual provisional weighting factors or using a maximum over the temporal averages of all relevant frequency bands. Preferably, temporal averaging over a period having a length of 0.1 s to 1 s is performed in this instance. Such temporal averaging makes it possible to prevent "pumping" of the background from arising in the output signal owing to brief fluctuations in the useful signal. Alternatively or additionally, the normalization can be effected by means of a fixed value for the normalization factor, which can in particular be dependent on an attenuation of the interference signal and on an absence of a useful signal (identifiable on the basis of the interference signal and the target signal). Such an approach has the advantage that in acoustic surroundings in which there is instantaneously no useful signal, everything is cut by said fixed value, which is generally often perceived to be more pleasant as a result of the noise or the disturbing noise as a single noise component.

Expediently, the target signal generated is a signal having a substantially omnidirectional directivity pattern, and the interference signal used is a directional signal having a relative attenuation in the target direction. Generation of a signal with a substantially omnidirectional directivity pattern is in particular intended to be understood in this instance to mean that the directivity pattern is obtained as a result of the signal generation. This can be effected firstly by means of a signal from an omnidirectional microphone as input transducer, or secondly by means of an omnidirectional sum-and-delay signal or delay-and-subtract signal from an array of input transducers.

The use of a directional signal with a relative attenuation in the target direction as interference signal in this instance firstly includes the attenuation being obtained as a result of the signal generation, e.g. as a result of differential directional microphones by means of the first and second input transducers. Secondly, however, an omnidirectional signal can also be generated (as described above), and the desired attenuation can be achieved e.g by way of shadowing effects. Within the context of the invention and its configurations, generation of a signal with a specific directivity pattern therefore in particular means the directivity pattern in the open field as the result of the electroacoustic signal generation, whereas the use of a signal with a specific directivity pattern can additionally also involve a directivity pattern that arises just on account of the spatial circumstances of use.

Preferably, the interference signal has a maximum, as far as possible total, attenuation in the target direction; in particular, in this instance the interference signal can be generated as an anticardioid directional signal using the signals from the first and second input transducers as a result of appropriate delayed overlay.

Preferably, to form the provisional weighting factor using a quotient, said quotient is limited in each particular case to an upper limit value of 6 dB, preferably 12 dB, particularly preferably 15 dB, which is advantageous if in the meantime there are no significant noise components opposite a strong useful signal. In the case of an anticardioid interference signal, such limiting can also be replaced or complemented by a notch of finite depth in the anticardioid directivity pattern, which can be achieved for example by means of a complex-value overlay parameter for the two signals from the input transducers.

In a more advantageous, possibly alternative, configuration, the target signal used is a directional signal that is oriented in the target direction and that has an almost complete attenuation in the half-space opposite the target direction. An almost complete attenuation in particular includes an attenuation of −10 dB, preferably −15 dB, as in the case of a signal with a lobe-shaped directivity pattern, for example. Preferably, the interference signal has as homogeneous a sensitivity as possible in said half-space, e.g. as a cardioid directional signal (with attenuation in the target direction), or as an omnidirectional signal.

Advantageously, the interference signal is generated at least using a first input transducer arranged in a housing, at least part of which is worn behind an auricle by a wearer of the hearing apparatus when the hearing apparatus is operated as intended. Preferably, the second or a further input transducer is also arranged in said housing. The interference signal is then preferably formed as a directional signal from the two corresponding input signals from the two input transducers (that is to say the first and the second or further input transducer). The target signal can in particular be formed as an omnidirectional signal from the two input signals generated by the first and second input transducers arranged in the housing.

To compare the useful signal with the interference signal, so-called roll-on compensation for the interference signal is preferably performed, e.g. by means of low-pass filtering, if the interference signal is generated as a delay-and-subtract directional signal of the input transducer signals, but the target signal is generated e.g, as a delay-and-sum signal or as a signal from only one input transducer. The low-pass filtering can be dispensed with if the target signal is also generated as a delay-and-subtract signal. However, the interference signal can also be generated from just one input transducer by making use of the natural shadowing effect of the auricle; the target signal is then preferably generated solely by the other input transducer, which e.g. may be arranged at the entrance to the ear canal.

In particular, the first and second input transducers are both arranged in the housing, which e.g. is embodied by a housing of a BTE or RIC hearing device. The interference signal can then be generated using differential directional microphones, the target signal as a "2-mic-omni" signal.

Expediently, the input signal to be processed is generated by an earpiece input transducer arranged in an earpiece, at least part of which is worn inserted in a concha and/or an ear canal by the wearer of the hearing apparatus when operated as intended. In particular, the earpiece input transducer can also be embodied by the first or second input transducer such that the input signal to be processed is also used to determine the interference signal and/or the target signal. The interference signal and the target signal can also be generated separately from the input signal to be processed, however, e.g. as described above in a BTE/RIC housing.

In a more advantageous configuration, the target signal is generated in a device that is external with respect to the hearing apparatus. In this instance, the external device is in particular intended to be understood to be part of the hearing system, and as such preferably designed to communicate with the hearing apparatus by way of an appropriate connection. The external device used in this instance can be a cell phone that is in particular set up for the method by an appropriate application that controls the microphone of the cell phone as first input transducer and also the signal transmission with the hearing apparatus. The comparison between the useful signal and the interference signal in this instance can preferably take place on the hearing apparatus, following appropriate transmission of the target signal or of the acoustic characteristic by the cell phone. Similarly, the interference signal can also preferably be generated by a second input transducer of the hearing apparatus and subsequently transmitted to the external device for appropriate comparison of the acoustic characteristics. The external device used can moreover be a dedicated external unit, e.g. a so-called partner unit for a hearing device as hearing apparatus.

The partner unit is worn on the body, e.g. around the neck, by an interlocutor of the wearer of the hearing device or is positioned in proximity thereto, for example on a table in front of him, in order to make words more audible for the wearer of the hearing device. In the context of the present invention, it is possible for just one input transducer of the partner unit to be used to generate the target signal, since the useful signal—the words of the interlocutor who is in direct proximity to the partner unit—are included in a signal generated by the partner unit in particularly emphasised form in comparison with any disturbing noise.

Expediently, the weighting factor is also formed in each particular case using a factor that takes into consideration volume differences and/or delay differences and/or spectral differences in the respective frequency band between the first input transducer and/or the second input transducer and/or the further input transducer for generating the input signal to be processed.

If for example the interference signal is generated by the first input transducer arranged in a housing, part of which should be worn behind the auricle by the wearer, and the target signal is generated by an input transducer arranged at the ear canal of the wearer, then the additional factor can e.g. take into consideration the shadowing effect of the auricle, which is possibly different over different frequency bands. Moreover, the factor can take into consideration a relative transfer function from the location of generation of the interference signal (e.g. housing on or behind the auricle) to the location of generation of the target signal (e.g. at the ear canal, or in an external unit), preferably with respect to the assumed useful signal source. This allows components arising as a result of different propagation of the sound to the location of generation of the interference signal or the location of generation of the target signal to be compensated for for the weighting factor.

In an advantageous configuration, the output signal is formed using the input signal to be processed, having been weighted with the respective weighting factors on a frequency-band-by-frequency-band basis, and a further omnidirectional signal and/or a further directional signal. In particular if the frequency-band-by-frequency-band application of the respective weighting factors to the input signal to be processed leads to artefacts, e.g. on account of the spectral distribution of the input signal, "admixture" of a directional signal (e.g. a cardioid directional signal) with a proportion of for example 25%, 30% or 40% (and a corresponding proportion of the weighted input signal to be processed of 75%, 70% or 60%) can decrease the audibility of artefacts while the natural sound is still retained. Similarly, an omnidirectionally generated signal (in particular in the cited proportions) can be admixed with the weighted input signal to be processed in order to form the output signal, which is particularly preferably generated by a different input transducer than the input signal to be processed.

It is found to be more advantageous if first weighting factors are ascertained on a frequency-band-by-frequency-band basis with regard to a first useful signal source arranged in a first target direction, second weighting factors are ascertained on a frequency-band-by-frequency-band basis with regard to a second useful signal source arranged in a second target direction, and the input signal to be processed is weighted in the respective frequency band using a weighting factor that is formed, preferably as a mean value or as a product, using the respective first weighting factor and using the respective second weighting factor.

This in particular means that: first weighting factors are determined with regard to a first useful signal source. This is effected using comparisons of acoustic characteristics that are obtained in each of the respective frequency bands from a first interference signal and a first target signal, which are referenced to the first useful signal source. By way of example, the first interference signal has a relative and in particular greatest possible attenuation in a first target direction, which is preferably embodied by the direction of the first useful signal source. Moreover, second weighting factors for the input signal to be processed are determined with regard to a second useful signal source, which is different than the first useful signal source, and is in particular situated in a second target direction, which is different than the first target direction.

This is likewise effected using comparisons of acoustic characteristics that are obtained in each of the respective frequency bands from a second interference signal and a second target signal, which are in turn referenced to the second useful signal source. By way of example, the second interference signal has a relative and in particular greatest possible attenuation in the second target direction. Those weighting factors that are now supposed to be applied to the input signal to be processed are now determined on a frequency-band-by-frequency-band basis using the first weighting factors (that is to say with regard to the first useful signal source) and using the second weighting factors (that is to say with regard to the second useful signal source), preferably using a product or an arithmetic mean, possibly weighted with an acoustic power of the respective useful signal sources, and in particular suitable global normalization.

Preferably, the hearing system has a further hearing apparatus, wherein at least for one frequency band the provisional weighting factor is ascertained in the hearing apparatus, a contralateral provisional weighting factor is transmitted to the hearing apparatus by the further hearing apparatus, and the weighting factor or a weighting factor for a contralateral input signal transmitted by the further hearing apparatus is ascertained by means of a comparison of the provisional weighting factor with the contralateral provisional weighting factor.

In particular, the hearing system in this case is embodied as a binaural hearing device system, wherein the hearing apparatus and the further hearing apparatus are each embodied by a single hearing device, each of which is to be worn on one ear. The contralateral input signal is then an input signal for one hearing device that is generated in the other hearing device and is transmitted for binaural signal processing. The contralateral provisional weighting factor is preferably formed in the other hearing apparatus in the same way as the provisional weighting factor in the hearing apparatus. The weighting factor to be applied by the hearing apparatus is then formed using a comparison of the "local" provisional weighting factor that was generated in the hearing apparatus with the contralateral provisional weighting factor from the other hearing apparatus. For a binaural hearing device system, this approach in particular permits the provisional weighting factors of both sides to be "synchronized", as it were, in individual frequency bands, as a result of which distortion of the "interaural level difference", for example, can be prevented, e.g. by using a mean value of the provisional weighting factors of both sides for the weighting factor in each particular case (or possibly a slightly higher weighting for the local provisional weighting factor compared to the contralateral provisional weighting factor, e.g. 0.6 to 0.4 or 0.7 to 0.3).

Preferably, the contralateral provisional weighting factor is transmitted to the hearing apparatus as a binary value, wherein the value of the provisional weighting factor is assigned to the contralateral weighting factor if a deviation in the contralateral provisional weighting factor from the provisional weighting factor does not exceed a predefined limit value. In particular, this means that: the contralateral provisional weighting factor is preferably discretized over three values or a few values more, and is compared with the "locally" available provisional weighting factor, the range of values of which can initially also comprise even more values. This range of values for the local provisional weighting factor can now firstly be mapped to coarser intervals (preferably in the same number as the range of values of the contralateral provisional weighting factor) for the comparison with the contralateral provisional weighting factor, as a result of which the weighting factor assigned—and possibly also normalized—is the local provisional weighting factor if the contralateral provisional weighting factor is in the same "coarser interval" as the "local" provisional weighting factor. If this is not the case, then the provisional weighting factors can be averaged for the weighting factor.

The invention also cites a hearing system having a hearing apparatus, wherein the hearing system contains at least two input transducers for generating an interference signal, a target signal and an input signal to be processed. The hearing apparatus contains at least one output transducer, and wherein the hearing system contains a control device that is set up to carry out the method described above. The hearing system according to the invention shares the advantages of the method according to the invention. The advantages indicated for the method and for its developments can be transferred mutatis mutandis to the hearing system.

The above description in respect of the method according to the invention applies analogously for the generation of the interference signal and the target signal by means of the at least two input transducers. The input signal to be processed can either be generated using one or both input transducers, which are also used for generating the interference signal and the target signal, or using a further input transducer of the hearing system.

The control device is preferably implemented in the hearing apparatus. If the hearing apparatus is embodied by a binaural hearing device system, the control device may also be embodied by all of the signal processing devices in both local units of the binaural system. To carry out the method described above, the hearing system can in particular comprise an external unit, which should not be regarded as part of the hearing apparatus, that is to say for example a cell phone or the like with an input transducer, which is in particular set up to generate the target signal and/or the interference signal, and possibly with a signal processing device, which can form part of said control device in this case too.

Preferably, the hearing apparatus is in the form of a hearing device. The use of the method described above is particularly advantageous for a hearing device that is in particular designed and set up to compensate for a hearing deficiency or a hearing loss of its wearer.

Preferably, the hearing device contains a housing in which a first input transducer and a second input transducer are arranged. The hearing device contains an earpiece in which a further input transducer for generating the input signal to be processed is arranged, and wherein the control device is set up to use the signals from the first input transducer and the second input transducer to form the interference signal and the target signal. This allows the interference signal and/or the target signal to be generated efficiently and quite literally in accurately targeted fashion by means of directional microphones for the purpose of obtaining the frequency-band-dependent weighting factors for the input signal to be processed, as a result of which particularly good noise rejection is possible. In this case, the input signal to be processed is generated at the ear canal of the wearer, and therefore contains particularly natural spatial information from the acoustic surroundings of the wearer, the natural shadowing effect of the auricle for the input signal to be processed being retained, which again promotes the natural spatial hearing impression.

Other features which are considered as characteristic for the invention are set forth in the appended claims.

Although the invention is illustrated and described herein as embodied in a method for direction-dependent noise rejection for a hearing system containing a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts and magnitudes are provided with the same reference signs in each particular case throughout the figures.

Figure 1A:
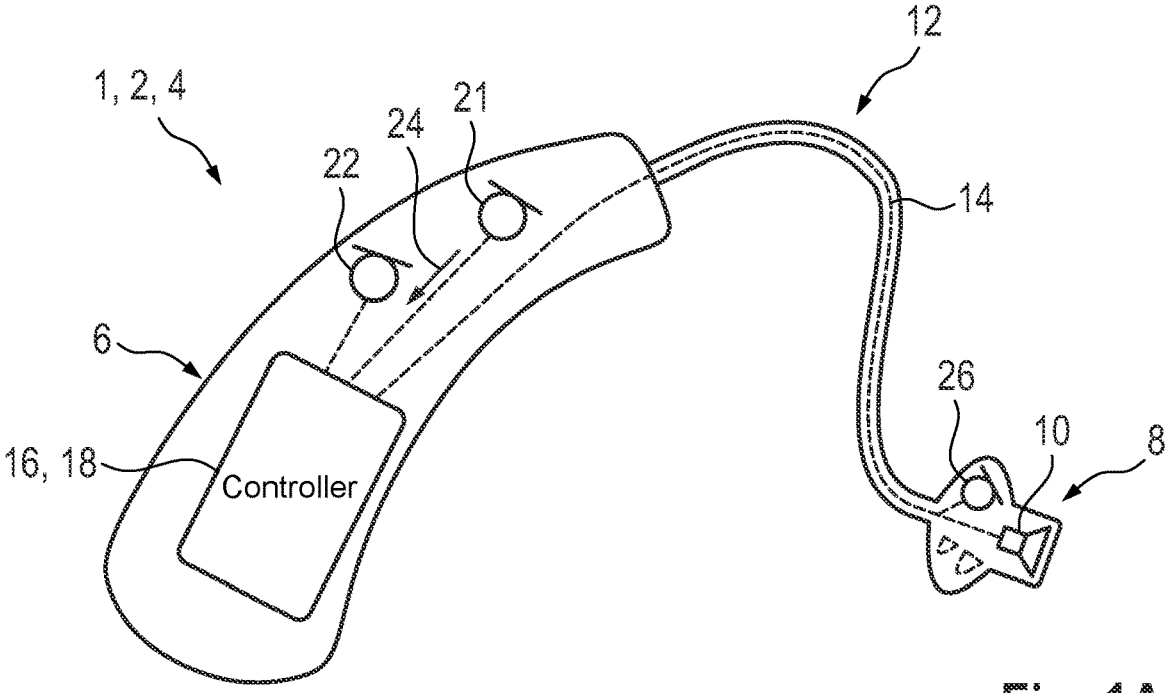
FIG. 1A is a diagrammatic, side view of a hearing device with a housing and an earpiece, two input transducers being arranged in the housing and one being arranged in the earpiece.

Referring now to the figures of the drawings in detail and first, particularly to FIG. 1A thereof, there is shown a side view of a hearing system 2 formed by a hearing apparatus 1. In this instance, the hearing apparatus 1 in the present case is embodied by a hearing device 4. The hearing device 4 has a housing 6, and an earpiece 8 connected to the housing 6. In the present case, the hearing device 4 is configured as an RIC device that has an output transducer 10 in the form of a loudspeaker at the end of the earpiece 8. A connection 12 mechanically connects the earpiece 8 to the housing 6; in this instance, a signal connection 14 that electronically connects the output transducer 10 to a signal processing device 16 in the housing 6 (dashed line) in a manner yet to be described also runs along the connection 12. The signal processing device 16 in this instance forms a control device 18 for the hearing system 2 and is in particular embodied by one or more signal processors that each have an assigned main memory. A first input transducer 21 and a second input transducer 22 are arranged at a slight distance from one another in the housing 6 and are each electronically connected to the control device 18 (dashed line).

During the operation of the hearing device 4, the first and second input transducers 21, 22 each generate input signals (not depicted in more detail) and output them to the signal processing device 16, where they are processed, and in particular amplified on a frequency-dependent basis and possibly compressed, on the basis of the individual audiological stipulations and requirements of a wearer of the hearing device 4. The signal processing device 16 uses the signal connection 14 to accordingly output an output signal (not depicted in more detail) to the output transducer 10, which converts the output signal into an output sound (not depicted in more detail) that is supplied to the ear of the wearer. Owing to the physical distance between the first and second input transducers 21, 22, spatial processing in the signal processing device 16 by means of directional microphones is also possible for the purpose of generating said output signal. As a result, it is possible to use the directional microphones to specifically emphasize a useful signal in the surroundings of the wearer, usually embodied by words of an interlocutor of the wearer, or to specifically cut ambient noise and/or other sound sources away from the useful signal source by means of directional microphones.

During this directionally sensitive signal processing, important information for spatial hearing can be lost for the wearer, however. The present hearing device 4 is therefore set up to use the signals from the first and second input transducers 21, 22 in a manner yet to be described to ascertain frequency-dependent weighting factors by means of which an a priori preferably omnidirectional input signal to be processed is weighted in the signal processing device 16, the weighting factors being supposed to bring about advantageous noise rejection across individual frequency bands. An input signal to be processed that can be used in this instance is in particular the signal 24 generated by the first input transducer 21.

Alternatively, the hearing device 4 can also have a further input transducer 26 in the earpiece 8, and the input signal to be processed can then be embodied by the signal from said further input transducer 26. In the present case, this has the advantage that when the hearing device 4 is worn as intended, wherein at least part of the housing 6 is worn by the wearer behind the auricle of one of his ears, and the earpiece 8 is inserted with the end of the output transducer 10 into the entrance to the associated ear canal, the further input transducer 26 is arranged in the region of the entrance to the ear canal, and therefore the signal generated by the further input transducer 26 has substantially the same behavior in respect of a shadowing effect of the head and in particular the auricle of the wearer as sound that reaches the ear of the wearer without the presence of the hearing device 4.

Figure 1B:
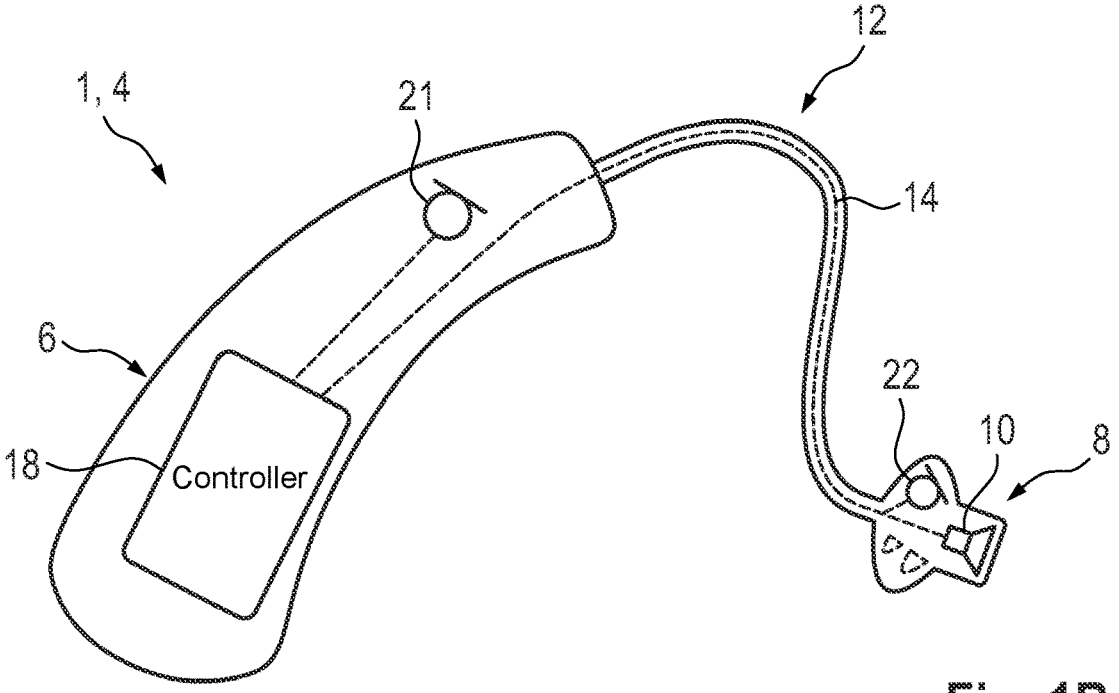
FIG. 1B is a side view showing the hearing device according to FIG. 1A, only one input transducer being arranged in the housing.

FIG. 1B schematically depicts a side view of an alternative configuration of the hearing apparatus 1 shown in FIG. 1A. In FIG. 1B too, the hearing apparatus 1 is embodied by a hearing device 4 in the form of an RIC device with a housing 6, part of which should be worn behind the auricle during operation, and an earpiece 8, wherein the housing 6 has a first input transducer 21 arranged in it that is signal-connected to a control device 18 that is likewise arranged in the housing 6. An output transducer 10 is arranged in the earpiece 8 and connected to the control device 18 by way of a signal connection 14, the signal connection 14 running along the mechanical connection 12 between the housing 6 and the earpiece 8. The earpiece 8 has the free end inserted into the entrance to the ear canal of the wearer for operation of the hearing device 4.

A second input transducer 22 is arranged in the earpiece 8. The signal from the first and second input transducers 21, 22 are used, analogously to the hearing device 4 according to the FIG. 1A, in a manner yet to be described to ascertain frequency-dependent weighting factors by means of which the input signal to be processed, which is generated by the second input transducer 22 in the present example, is weighted in the control device 18 for the purpose of noise rejection. A significant difference here as compared with the hearing device 4 depicted in FIG. 1A is therefore that the second input transducer 22, the signal from which is used to determine the frequency-dependent weighting factors, is arranged in the earpiece 8 (and not, like the first input transducer 21, in the housing 6).

The hearing device 4 according to FIG. 1A or according to FIG. 1B can in particular also be in the form of a BTE device, in which case the connection 12 is formed by the sound tube of the BTE device. In particular, the second input transducer 22 can be arranged in the housing 6 of the BTE device. If the second input transducer (or the further input transducer 26 according to FIG. 1A) is arranged in or on the earpiece 8 (the free end of which is formed by e.g. a dome or an earmold in the case of a BTE device), then the signal connection 14 to the control device 18 in the housing 6 runs along the sound tube, preferably in a dedicated cable. In particular, a signal processing device 16 as a part of the control device 18 can also be arranged in the earpiece 8. If the earpiece 8 has an input transducer, then the hearing device 4 can in particular be embodied by a type of combination of a BTE or RIC device with an ITE or CIC device.

Figure 2:
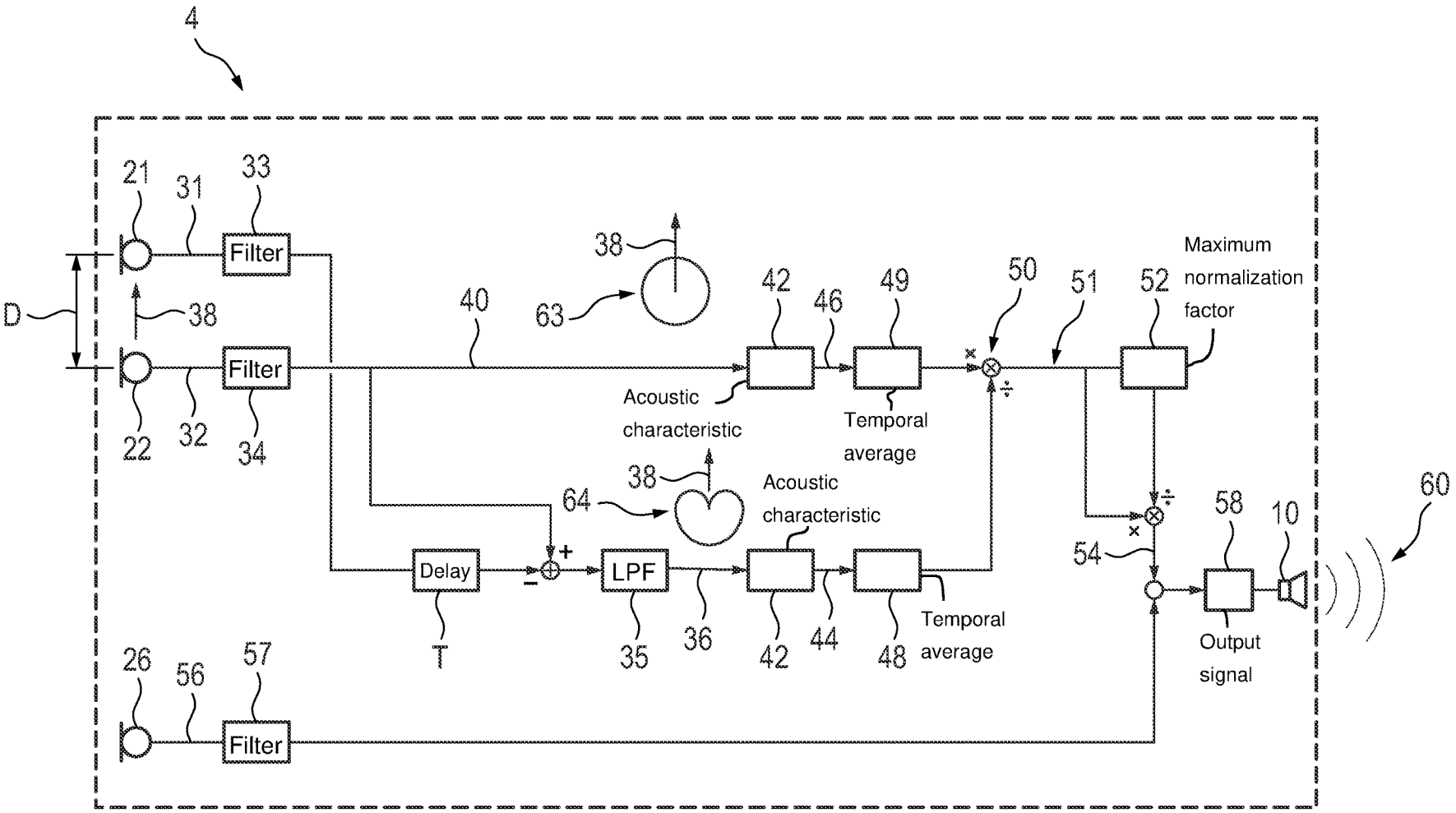
FIG. 2 is a block diagram of noise rejection in the hearing device according to FIG. 1A by means of weighting factors that are determined by means of directional microphones.

FIG. 2 uses a block diagram to schematically depict the hearing system 1, formed by the hearing device 4, according to FIG. 1A with the already outlined signal processing for noise rejection. The hearing device 4 comprises the first input transducer 21 and the second input transducer 22, which is arranged at a distance D from the first input transducer. The first input transducer 21 generates a first signal 31 and the second input transducer 21 generates a second signal 32 from ambient sound, which is not depicted in more detail. Possible pre-amplification and preprocessing such as for example wideband compression and A/D conversion are already supposed to be included in the function of the first and second input transducers 21, 22 in this case.

The first and second signals 31, 32 are now each transformed to the time/frequency domain in filter banks 33, 34. The thus filtered first signal 31 is now delayed by a time constant T on a frequency-band-by-frequency-band basis in each particular case, possibly also filtered using a complex transfer function (not depicted), which can possibly take into consideration level and/or phase differences of the two input transducers 21, 22, and subtracted from the filtered signal 32, and subsequently filtered using a low-pass filter 35. The low-pass filtering is effected because the subtraction attenuates low-frequency signal components, since the time constant T, as the acoustic time of flight between the two input transducers 21, 22 owing to the distance D, leads to low-frequency signal components in both input transducers 21, 22 still having similar amplitudes despite the propagation.

The low-pass filtering now results in an interference signal 36 that, owing to the time delay T before the subtraction of the two input signals 31, 32, which corresponds exactly to the acoustic time of flight for the distance D, has, in each frequency band, a substantially anticardioid directivity pattern 64, the maximum attenuation of which points in a target direction 38 embodied by a connecting line from the second input transducer 22 to the first input transducer 21 and coincides with the front direction when the hearing device 4 is worn as intended.

The second signal 32 broken down into individual frequency bands by the filter bank 34 has, as microphone signal, a substantially omnidirectional directivity pattern 63 for each frequency band. This second signal 32 is now used as target signal 40. From the target signal 40 and from the interference signal 36 in each frequency band, an acoustic characteristic 42 is now ascertained in each particular case, the acoustic characteristic being supposed to provide information about the energy content of the relevant signal in the respective frequency band in each particular case. This is ensured in the present case by virtue of the acoustic characteristic 42 chosen being the absolute value of the respective signal. In particular, a signal power or a signal level or a monotonous, e.g. quadratic or logarithmic, function of the signal power, of the absolute value or of the signal level can also be used as characteristic 42, however. From the absolute value 44 of the interference signal 36 and from the absolute value 46 of the target signal 40, temporal averages 48 and 49 are now formed in each particular case for smoothing purposes. Subsequently, a quotient 50 of the temporal average 49 of the absolute value 46 of the target signal 40 as numerator and the temporal average 48 of the absolute value 44 of the interference signal 36 as denominator is formed. This quotient, which may also be able to be limited to an upper limit value of for example 6 dB or higher (e.g. 12 dB or 15 dB), forms a provisional weighting factor 51 for the respective frequency band.

A maximum 52 of the provisional weighting factors 51 is now determined over all frequency bands and stipulated as normalization factor 52. The provisional weighting factors 51 are normalized using the normalization factor 52 ascertained in this manner, as a result of which a weighting factor 54 is obtained for each frequency band.

The further input transducer 26 is used to generate an input signal 56 to be processed. The input signal 56 to be processed is transformed to the time-frequency domain by a filter bank 57. The filter banks 33, 34, 57 preferably have an identical frequency resolution and identical edge gradient.

The weighting factor 54 is now applied by multiplication to the thus transformed input signal 56 to be processed. The frequency-band-by-frequency-band signal components of the input signal 56 to be processed that are weighted as described are used to generate, for example by means of inverse fast Fourier transformation, a wideband output signal 58 that is converted into an output sound 60 by the output transducer 10. Before the output signal 58 is generated, additional signal processing, not depicted in more detail, can in particular also take place, which can comprise for example a frequency-band-by-frequency-band cut or boost for the signal components on the basis of the individual audiological requirements of the wearer, and/or additional measures for rejecting disturbing noise, and/or acoustic feedback. In particular, to apply the weighting factor 54 to the input signal 56 to be processed in the respective frequency band, an absolute value and a phase can first be ascertained from the input signal 56 to be processed, the weighting factor 54 being applied only to the absolute value, and the phase being used for a back-transformation to generate the output signal 58.

In order to apply the noise rejection depicted on the basis of FIG. 2 to the hearing device 4 according to FIG. 1B, the input signal 56 to be processed is generated by the first or the second input transducer 21 or 22. The directional signal 56 to be processed therefore corresponds to the first or second signal 31 or 32. In general, further alternative configurations of the hearing device 4 are also conceivable for the noise rejection, for example a so-called ITE hearing device having two input transducers arranged in the region of the ear canal as first and second input transducers 21, 22 for generating the two signals 31, 32 and the input signal 56 to be processed.

Figure 3:
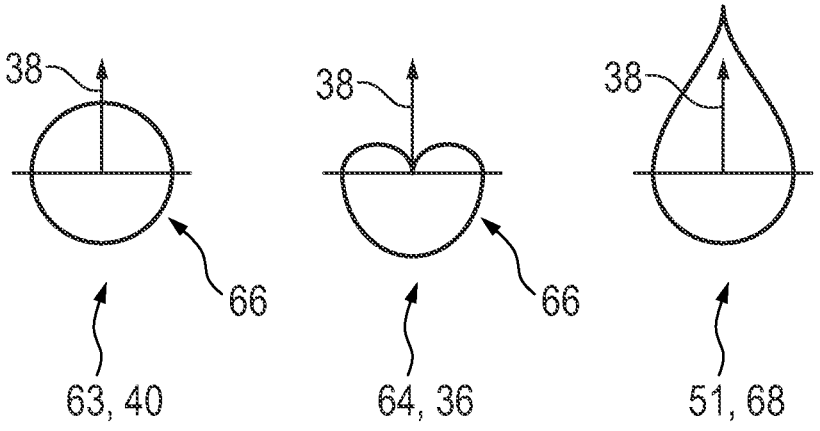
FIG. 3 is an illustration showing a directional dependency of provisional weighting factors in the hearing device according to FIG. 2.

FIG. 3 uses a plan view to schematically show the effect of the provisional weighting factor 51 according to FIG. 2 in respect of sound signals from different spatial directions in a simplified manner. The left-hand image shows a wearer 62 of the hearing device 4 and the omnidirectional directivity pattern 63 of the target signal 40, the directivity pattern surrounding him. The middle image depicts the same wearer 62 again, this time with the anticardioid directivity pattern 64 of the interference signal 36, which directivity pattern has its maximum attenuation in the target direction 38. It can immediately be seen that no significant attenuation takes place for a sound signal from the half-space 66 opposite the target direction 65 as a result of the interference signal 36, since the anticardioid directivity pattern 64 has a substantially homogeneous characteristic there in a similar manner to the omnidirectional directivity pattern 63.

The right-hand image depicts the directional dependency 68 of the provisional weighting factor 51, as can be imagined schematically from the two directivity patterns 63, 64. Whereas the target signal 40 and the interference signal 36 have a largely similar sensitivity toward sound signals in the rear half-space 66, the provisional weighting factor 51 has a substantially homogeneous and therefore directionally independent characteristic in this region. Only as the target direction 38 is approached to an increasing extent do the differences in the two directivity patterns 63, 64 become increasingly noticeable, which means that the provisional weighting factor 51 has a severe bulge in the target direction 38. This bulge can be limited to a finite value in this case in particular by means of compression or limiting.

Owing to the considerable boost in the target direction 38, the approach outlined with reference to FIG. 2 can now involve the normalization using the maximum 52 of all provisional weighting factors 51 being used to achieve the effect that the weighting factor 54 is currently 1 only in that frequency band in which the maximum spectral proportion of useful signal from the target direction 38 is present. Owing to the division of the provisional weighting factors 51 by the normalization factor 52, the weighting factor 54 results in a cut being effected for other frequency bands that ends up being all the greater the smaller the spectral proportion of useful signal from the target direction 38 in the respective frequency band.

Figure 4:
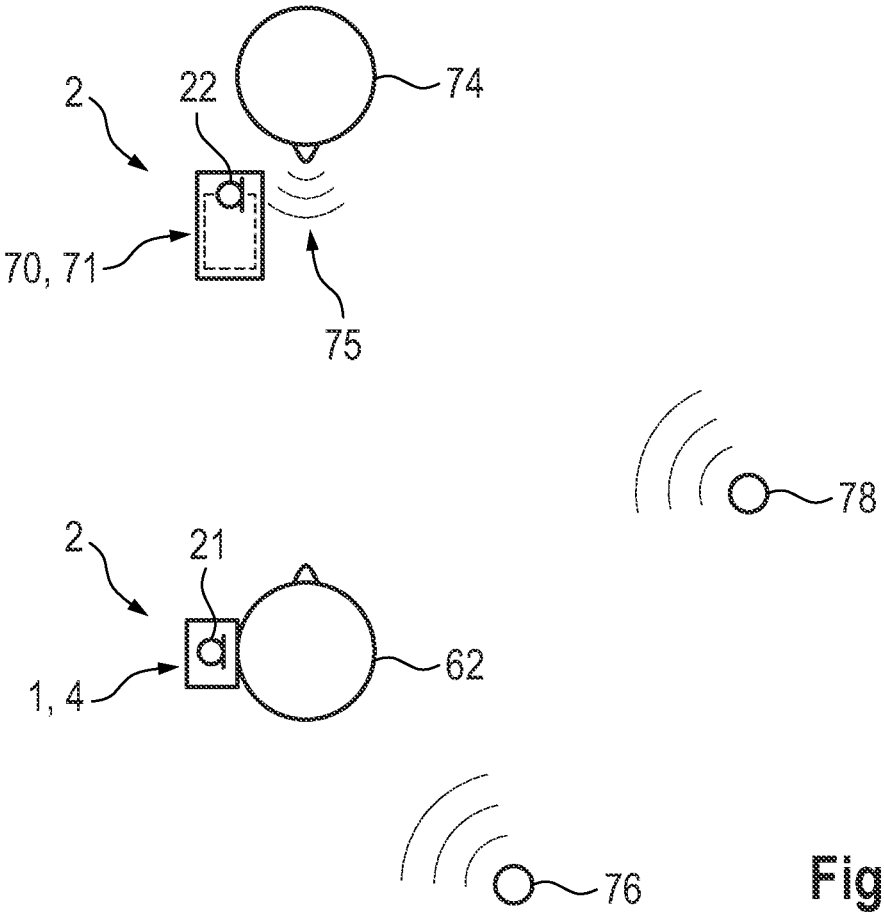
FIG. 4 is an illustration showing a hearing system with a hearing device and a cell phone.

FIG. 4 uses a plan view to schematically depict an alternative configuration of the hearing system 2 with respect to the variants shown in FIGS. 1A and 1B, which comprises a hearing apparatus 1 and an external device 70. The external device 70 is embodied by a cell phone 71. The hearing apparatus 1 is embodied by a hearing device 4 that is worn by the wearer 62 on one ear (not depicted in more detail). The hearing device 4 has at least one first input transducer 21 and can be configured as an ITE device, for example. The cell phone 71 is positioned directly in front of an interlocutor 74 of the wearer 62 such that a microphone of the cell phone, as second input transducer 22 of the hearing system 1, can record words 75 of the interlocutor 74 without hindrance and particularly clearly.

So as now to be better able to reject noise, e.g. in the form of disturbing noise from the directional sources of interference 76, 78, which in their nature are not specified in more detail, or diffuse background noise (not depicted in more detail), by means of the hearing device 4, the signals from the first input transducer 21 arranged in the hearing device 4 and from the second input transducer 22 arranged in the cell phone 71 are used in a manner yet to be described to generate frequency-dependent weighting factors that are applied to the signal from the first input transducer 21 in the hearing device 4. The weighting factors are generated such that spectral components of the sources of interference 76, 78 (or diffuse background noise) in the signal from the first input transducer 21, which ultimately represents the overall sound occurring there, are preferably cut by the weighting that takes place. Furthermore, spectral components of the words 35 are preferably supposed to be retained by the weighting and in particular boosted relative to the disturbing noise from the sources of interference 76, 78.

This is done by virtue of the weight factors being obtained on a frequency-band-by-frequency-band basis using a target signal and an interference signal, the target signal being supposed to contain as high a relative proportion of the useful signal (referenced e.g. to the total energy in a frequency band), that is to say of the words 75 in the present case, as possible and the interference signal being supposed to contain as low a relative proportion of the useful signal as possible. Similarly, a level of rejection of the sources of interference 76, 78 should preferably not be dependent on the direction thereof, but rather should preferably be dependent merely on the volume thereof. This stipulation is achieved by virtue of the interference signal used being the signal from the first input transducer 21 and the target signal used being the signal from the second input transducer 22. The signal from the second input transducer 22 has a particularly high proportion of words 75 of the interlocutor 74 owing to the positioning of the cell phone 71, whereas, solely on account of the physical distance of the wearer 62 from the interlocutor 74, the first input transducer 21 in the hearing device 4 will pick up a lower proportion of words 75, and therefore higher spectral proportions of the sources of interference 76, 78 are recorded in the signal from the first input transducer.

In particular, the hearing system 2 can also be configured as a binaural hearing device system that, in addition to the hearing device 4, has a further hearing device (not depicted) with the second input transducer, which the wearer 62 should wear on the other ear. Provisional weighting factors 51 can first of all be determined in this further hearing device in a similar manner to in the hearing device 4, as already described (cf. FIG. 2). These provisional weighting factors, which are then contralateral with reference to the hearing device 4, are transmitted to the hearing device 4, where the weighting factors to be applied locally in the hearing device 4 for the individual frequency bands can firstly be generated on the basis of a comparison of the local provisional weighting factors with the contralateral provisional weighting factors.

Secondly, the contralateral provisional weighting factors can also be used for the purposes of binaural signal processing if for example a signal to be processed is additionally also transmitted from the (contralateral) further hearing device to the hearing device 4. Weighting factors that are to be applied to the contralateral signal from the further hearing device in the hearing device 4 for the purposes of binaural signal processing are then formed using the contralateral provisional weighting factors.

Figure 5:
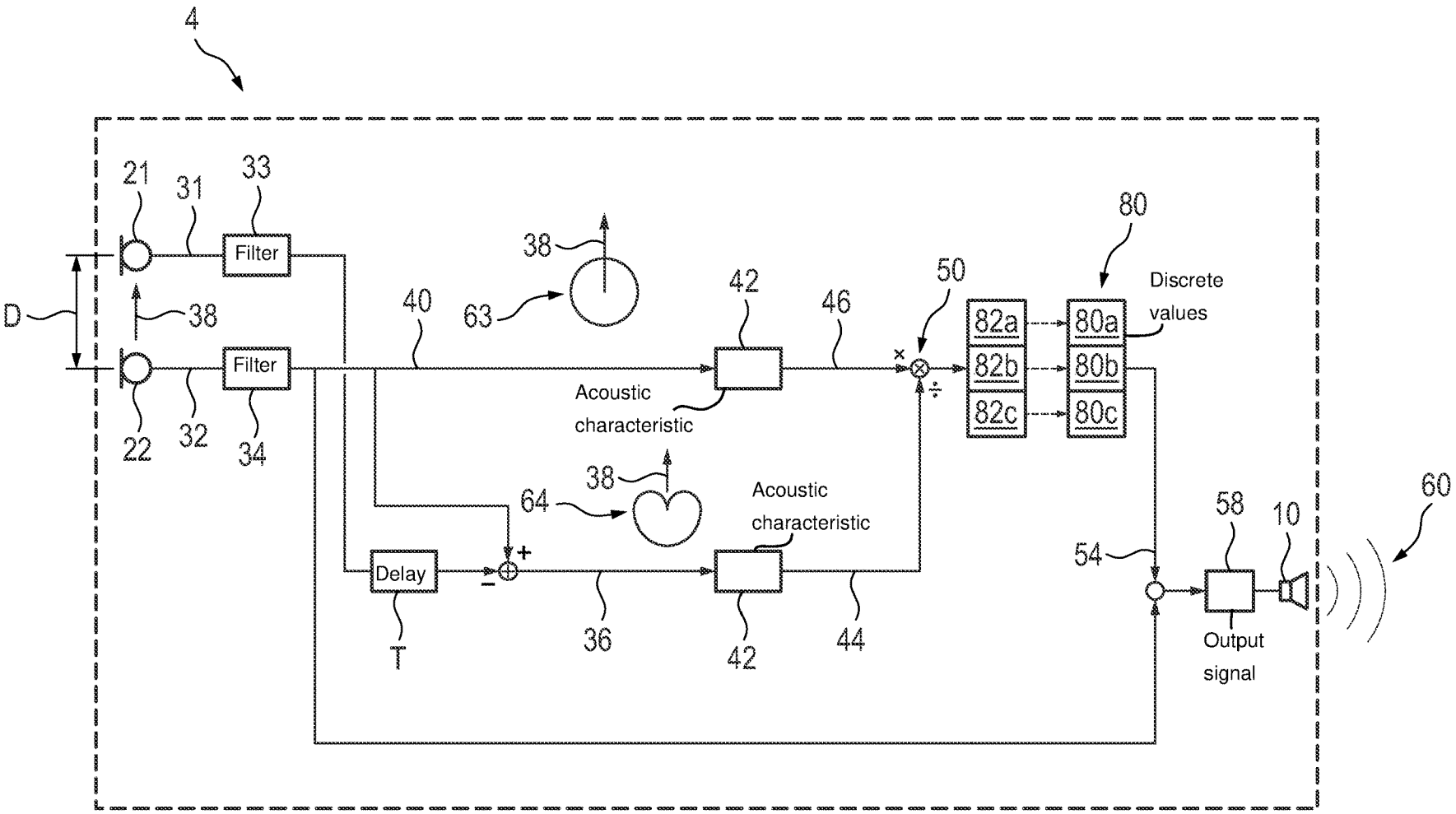
FIG. 5 is a block diagram showing an alternative noise rejection to that in FIG. 2 in the hearing device according to FIG. 1A.

FIG. 5 uses a block diagram to schematically depict an alternative to the noise rejection according to FIG. 2 for the hearing device 4 shown therein. Up to the formation of the quotient 50 of the absolute value 46 of the useful signal 40 as numerator and the absolute value 44 of the interference signal 36 as denominator, the signal processing in this case can proceed substantially identically (the low-pass filter 35 for the interference signal 36 has not been shown for the sake of simplicity), the input signal 56 to be processed additionally being embodied in the present case by the second signal 32 in the time-frequency domain (and therefore that is to say the useful signal 40). Similarly, the signal to be processed that is used could also be the first signal 31

(in the time-frequency domain) or the signal from a further input transducer 26 (which is not provided in the exemplary embodiment according to FIG. 5), however.

In contrast to the exemplary embodiment depicted with reference to FIG. 2, the weighting factor 54 can now also be produced in the individual frequency bands by virtue of the quotient 50 being mapped in each particular case to a discrete range of values 80 comprising e.g. three values 80*a*, 80*b*, 80*c* for the provisional weighting factor 51. By way of example, an upper, a middle and a lower interval 82*a*, 82*b*, 82*c* are stipulated for the quotient 50, these being mapped to the largest value 80*a* (e.g. 1 or 1.3 or a value in between) or the middle value 80*b* (e.g. 0.75 or the like) or the smallest value 80*c* (e.g. 0.5 or less) for the provisional weighting factor 51 in each particular case. The provisional weighting factor 51 thus produced can moreover also be temporally smoothed. Normalization (not depicted) is also possible (in particular if the largest value stipulated in the discrete range of values is a value #1).

In a similar manner (not depicted), the acoustic characteristic 42 of the target signal 40, that is to say the absolute value 46 of said acoustic characteristic in the present example, and the corresponding acoustic characteristic 42 of the interference signal 36, that is to say the absolute value 44 of the acoustic characteristic in the present case, can also be subjected to a greater-than-less-than comparison. If the absolute value 46 of the target signal 40 is greater than the absolute value 44 of the interference signal 36, the provisional weighting factor 51 assigned is the largest value 80*a* in the predefined, discrete range of values 80. If, however, the absolute value 44 of the interference signal 36 is greater, then the absolute value 46 of the target signal 40 is scaled by a factor >1 (e.g. 1.1 or 1.2), and again compared with the absolute value 44 of the interference signal 36. If the absolute value 46 of the target signal 40 is now greater, the provisional weighting factor 51 assigned is the middle value 80*b* in the discrete range of values 80, otherwise the smallest value 80*c*. Although the, cascaded, greater-than-less-than comparisons with interim scaling can likewise be mathematically formulated as the above-described mapping of the quotient 50 to the discrete range of values 80 for the provisional weighting factor 51, in practice they are sometimes easier to implement e.g. on hardwired circuits.

Although the invention has been illustrated and described more thoroughly in detail by the preferred exemplary embodiment, the invention is not limited by the disclosed examples, and other variations can be derived therefrom by a person skilled in the art without departing from the scope of protection of the invention.

The following is a summary list of reference numerals and the corresponding structure used in the above description of the invention:

1 hearing apparatus
2 hearing system
4 hearing device
6 housing
8 earpiece
10 output transducer
12 connection
14 signal connection
16 signal processing device
18 control device
21 first input transducer
22 second input transducer
24 input signal
26 further input transducer
31 first signal
32 second signal
33 filter bank
34 filter bank
35 low-pass filter
36 interference signal
38 target direction
40 target signal
42 acoustic characteristic
44 absolute value of the interference signal
46 absolute value of the target signal
48 temporal average
49 temporal average
50 quotient
51 provisional weighting factor
52 maximum/normalization factor
54 weighting factor
56 input signal to be processed
57 filter bank
58 output signal
60 output sound
62 wearer
63 omnidirectional directivity pattern
64 anticardioid directivity pattern
66 half-space
68 directional dependency
70 external device
71 cell phone
74 interlocutor
75 words
76 source of interference
78 source of interference
80 discrete range of values
80*a* largest value
80*b* middle value
80*c* smallest value
82*a* upper interval
82*b* middle interval
82*c* lower interval

The invention claimed is:

1. A method for direction-dependent noise rejection for a hearing system having a hearing apparatus, which comprises the steps of:

using at least one first input transducer of the hearing system and a second input transducer of the hearing system to generate an interference signal and a target signal from a sound from surroundings, the interference signal and/or the target signal being referenced to a useful signal source disposed in a target direction;

generating the target signal with a target directivity pattern that has a homogeneous or substantially homogeneous characteristic over a half-space opposite the target direction;

comparing, for each of at least one first plurality of frequency bands, an acoustic characteristic of the target signal with a corresponding acoustic characteristic of the interference signal, and a comparison is used to ascertain a provisional weighting factor, a range of values of which containing at least three values, the provisional weighting factor being used to form for a frequency band a weighting factor for a respective frequency band in each particular case; and weighting an input signal to be processed for the hearing system on a frequency-band-by-frequency-band basis using the respective weighting factor resulting in a weighted input signal, and the weighted input signal to be processed is used to generate an output signal.

2. The method according to claim 1, wherein the weighting factor is formed for each of a second plurality of frequency bands using the provisional weighting factor and using a normalization factor that is determined on a basis of at least one provisional weighting factor of the second plurality of frequency bands.

3. The method according to claim 2, wherein the normalization factor for a frequency band is determined using a temporal average of values of the acoustic characteristics used and/or of values of the provisional weighting factor in a same frequency band; and/or which further comprises using a maximum and/or a sum of the values of the provisional weighting factors and/or of a signal level over all relevant frequency bands.

4. The method according to claim 1, which further comprises forming a quotient for each of at least some of the frequency bands of the first plurality using the acoustic characteristic of the target signal as numerator and using the corresponding acoustic characteristic of the interference signal as denominator, and the quotient is used to form the provisional weighting factor.

5. The method according to claim 4, wherein the quotient for each of the frequency bands determined to be relevant frequency bands is mapped monotonously to the range of values containing the at least three values (80*a*, 80*b*, 80*c*), being discrete values, to form the provisional weighting factor.

6. The method according to claim 1, wherein for at least some frequency bands of the first plurality:

the acoustic characteristic of the target signal and the corresponding acoustic characteristic of the interference signal are subjected to a plurality of magnitude comparisons;

one of the two acoustic characteristics is scaled differently for individual ones of the magnitude comparisons; and the magnitude comparisons are used to assign a respective value from the at least three values of the range of values to the provisional weighting factor.

7. The method according to claim 1, wherein:

the target signal generated is a signal having a substantially omnidirectional directivity pattern; and the interference signal used is a directional signal having a relative attenuation in the target direction.

8. The method according to claim 1, wherein the target signal used is a directional signal that is oriented in the target direction and that has an almost complete attenuation in the half-space opposite the target direction.

9. The method according to claim 1, wherein the interference signal is generated at least using the first input transducer disposed in a housing, at least part of which is worn behind an auricle by a wearer of the hearing apparatus.

10. The method according to claim 1, wherein the input signal to be processed is generated by an earpiece input transducer disposed in an earpiece, at least part of which is worn inserted in a concha and/or an ear canal by a wearer of the hearing apparatus.

11. The method according to claim 1, wherein the target signal is generated in a device that is external with respect to the hearing apparatus.

12. The method according to claim 1, wherein the weighting factor is also formed in each particular case using a factor that takes into consideration volume differences and/or delay differences and/or spectral differences in the respective frequency band between the at least one first input transducer and/or the second input transducer and/or a further input transducer for generating the input signal to be processed.

13. The method according to claim 1, wherein the output signal is formed using the input signal to be processed, having been weighted with weighting factors on a frequency-band-by-frequency-band basis, and a further omnidirectional signal and/or a further directional signal.

14. The method according to claim 1, wherein:

first weighting factors are ascertained on a frequency-band-by-frequency-band basis with regard to a first useful signal source disposed in a first target direction;

second weighting factors are ascertained on a frequency-band-by-frequency-band basis with regard to a second useful signal source disposed in a second target direction; and the input signal to be processed is weighted in the respective frequency band using the weighting factor that is formed using a respective said first weighting factor and using a respective said second weighting factor.

15. The method according to claim 1, wherein:

the hearing system has a further hearing apparatus;

at least for one frequency band, the provisional weighting factor is ascertained in the hearing apparatus;

a contralateral provisional weighting factor is transmitted to the hearing apparatus by the further hearing apparatus; and the weighting factor or a weighting factor for a contralateral input signal transmitted by the further hearing apparatus is ascertained by means of a comparison of the provisional weighting factor with the contralateral provisional weighting factor.

16. The method according to claim 15, wherein:

transmitting the contralateral provisional weighting factor to the hearing apparatus as a binary value; and a value of the provisional weighting factor is assigned to the contralateral weighting factor if a deviation in the contralateral provisional weighting factor from the provisional weighting factor does not exceed a predefined limit value.

17. A hearing system, comprising:

at least first and second input transducers for generating an interference signal, a target signal and an input signal to be processed;

a hearing apparatus having at least one output transducer; and a controller for performing a method for direction-dependent noise rejection, the controller being programmed to:

use the first input transducer and the second input transducer to generate an interference signal and a target signal from a sound from surroundings, the interference signal and/or the target signal being referenced to a useful signal source disposed in a target direction;

generate the target signal with a target directivity pattern that has a homogeneous or substantially homogeneous characteristic over a half-space opposite the target direction;

compare, for each of at least one first plurality of frequency bands, an acoustic characteristic of the target signal with a corresponding acoustic characteristic of the interference signal, and a comparison is used to ascertain a provisional weighting factor, a range of values of which containing at least three values (80*a*, 80*b*, 80*c*), the provisional weighting factor being used to form for a frequency band a weighting factor for a respective frequency band in each particular case; and weight an input signal to be processed for the hearing system on a frequency-band-by-frequency-band basis using the respective weighting factor resulting in a weighted input signal, and the weighted input signal to be processed is used to generate an output signal.

18. The hearing system according to claim 17, wherein said hearing apparatus is a hearing device.

19. The hearing system according to claim 18, wherein:

said hearing device has a housing in which said first input transducer and said second input transducer are disposed;

said hearing device has an earpiece in which a further input transducer for generating the input signal to be processed is disposed; and said controller is set up to use signals from said first input transducer and said second input transducer to form the interference signal and the target signal.

* * * * *